United States Patent [19]

Blanc et al.

[11] 4,185,773

[45] Jan. 29, 1980

[54] METHOD OF MANUFACTURING 12 TO 14% MN STEEL COMPONENTS WITH WELDABLE END PIECES

[75] Inventors: Pierre Blanc, Barfleur; Robert Perrot, Hardelot-Plage, both of France

[73] Assignee: Societe des Acieries de Paris et D'Outreau, Paris, France

[21] Appl. No.: 736,699

[22] Filed: Oct. 29, 1976

[30] Foreign Application Priority Data

Oct. 31, 1975 [FR] France ..... 75 33434
Dec. 31, 1975 [FR] France ..... 75 40243

[51] Int. Cl.[2] ..... B22D 19/00

[52] U.S. Cl. ..... 238/150; 164/136; 164/98; 249/86; 238/164

[58] Field of Search ..... 164/54, 92, 98, 332; 249/86; 228/241; 238/150, 151, 162, 164, 167

[56] References Cited

U.S. PATENT DOCUMENTS

| | | | |
|---|---|---|---|
| 1,671,412 | 5/1928 | Deppeler | 164/134 |
| 1,671,413 | 5/1928 | Dickson | 164/54 |
| 2,633,302 | 11/1948 | Cooper | 238/164 |
| 3,113,359 | 12/1963 | Burke | 249/86 X |

FOREIGN PATENT DOCUMENTS

| | | | |
|---|---|---|---|
| 466004 | 9/1928 | Fed. Rep. of Germany | 164/54 |
| 316653 | 10/1956 | Switzerland | 164/54 |
| 178193 | 4/1922 | United Kingdom | 164/92 |

*Primary Examiner*—Robert D. Baldwin
*Assistant Examiner*—K. Y. Lin

[57] ABSTRACT

Method of manufacturing steel components containing 12 to 14% by weight of manganese having an austenitic structure, said parts being provided with steel end pieces having a mainly austenitic structure permitting their junction by welding to components made of any desired alloy, wherein, before applying thermal treatment, said end pieces are cast into moulds disposed directly at the ends of said manganese steel components. The ends of the manganese steel component are shaped and the end pieces are subsequently cast thereon in such a manner that each end of the part comprises a front surface inclined about a transverse horizontal axis.

5 Claims, 5 Drawing Figures

METHOD OF MANUFACTURING 12 TO 14% MN STEEL COMPONENTS WITH WELDABLE END PIECES

BACKGROUND OF THE INVENTION

1. Field of the invention

The present invention relates to a method of manufacturing steel components containing 12 to 14 percent by weight of manganese having an austenitic structure, and more particularly track components, notably crossings, provided with steel end pieces having a mainly austenitic structure permitting their junction with components made of any desired alloy, notably with the rails of a line network, without any discontinuity.

2. Description of the prior Art

It is already known to cast these end pieces directly into moulds disposed at the ends of the track component, before applying a thermal treatment to the assembly for converting the heterogeneous austenitic structure of the track component proper into a pure austenitic structure, this thermal treatment consisting as a rule of a hyper-hardening treatment accomplished in the conventional manner in a range of temperature within 900° to 1,200° C.

However, it appeared that a simple end to end junction between for example the ends of crossings and their end pieces, obtained by casting directly on a straight section into a Vignole profile mould, did not possess sufficient safety and strength characteristics.

SUMMARY OF THE INVENTION

It is the essential purpose of the present invention to provide track components with end pieces incorporating a definitely improved component-to-end piece junction, in order to avoid the risk of cracks or breakages at the junction between the track component proper and its end pieces.

In the method described in detail hereinafter, this end piece is fitted between the manganese-steel track component and the rail after connecting same, therefore said end piece cannot become loose in case of breakage in actual service.

The method of this invention is characterized mainly in that the ends of the track components proper, on which the end pieces are to be subsequently cast, are so shaped that each end comprises a front surface inclined about a transverse horizontal axis. Thus, the connecting area between each end of the track component and the corresponding end piece is flexion stressed instead of being submitted to considerable shearing forces when said end piece, in the vicinity of this junction, carries a load that is not also supported by the adjacent end of the track component, or vice versa.

This effect can be improved with, in addition, the benefit of complementary advantages, by shaping each end of the component in such a manner that this end, in addition to said inclined front surface, comprises a pair of opposite lateral surfaces inclined towards the plane of symmetry of said end of the track component and also upwardly, said front surface having in this case a triangular or trapezoidal shape with the minor base thereof coincident with or level with the running surface or tread of each one of said ends.

Advantageously, the end piece is cast on the end of the track component in such a manner that the head of the end piece lies under the flange or foot and be cast before this flange or foot. Thus, a sounder, inclusion-free head is obtained.

Preferably, track components having a tubular section, at least in the vicinity of their ends, are used. The greater regularity of the metal thickness of the corresponding cross-section, compared with the cross-section of a rail, notably a Vignole rail, facilitates considerably the binding of the track components with their end pieces.

A more regular casting operation is obtained by causing the filled crucible to travel over the mould in a longitudinal direction with respect to the track component, during the end piece casting operation.

According to a modified precedure applicable for carrying out the method of this invention, the end pieces are cast at the end of the rough-cast track component proper without allowing the latter to cool down. For this purpose, the solid potions of the mould for casting said track component comprises in the vicinity of its ends a partition permitting, immediately after the casting step, of freeing its ends and fitting another mould for casting the end pieces.

Moreover, the mould utilized for casting said end pieces is designed preferably with a view to impart to each end piece on the one hand a profile similar to that of a solid section of the end of said track component, in the portion thereof to be connected with said end piece, and on the other hand a rail cross-section, for example the section of a Vignole rail, to the opposite end of said end piece.

BRIEF DECRIPTION OF THE DRAWINGS.

A typical form of embodiment of this invention will now be described by way of example with reference to the attached drawings, in which.

DESCRIPTION OF THE PREFERRED EMBODIMENT

Figure 1:
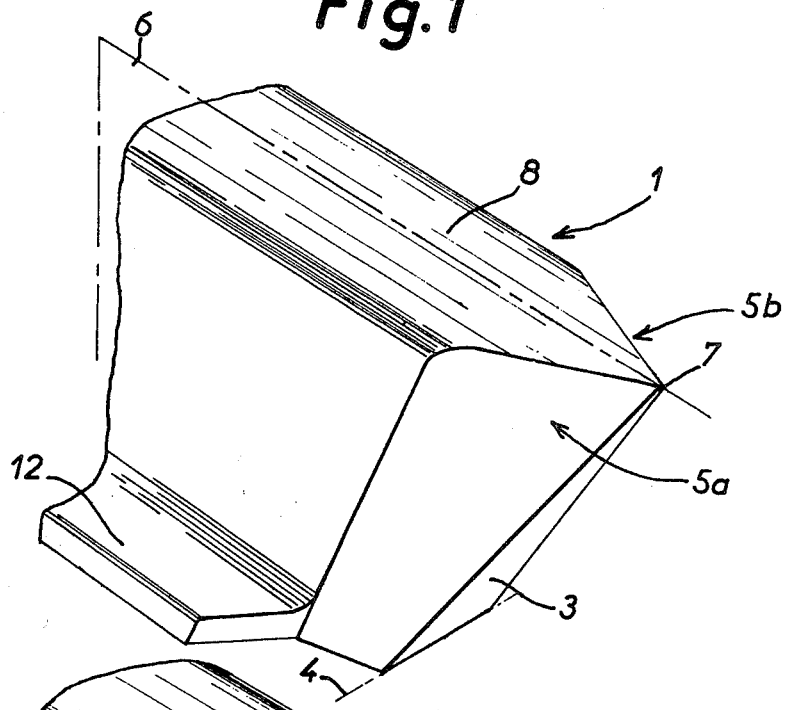
FIG. 1 is a perspective view of the end of a track component utilized for carrying out this invention.
Figure 2:
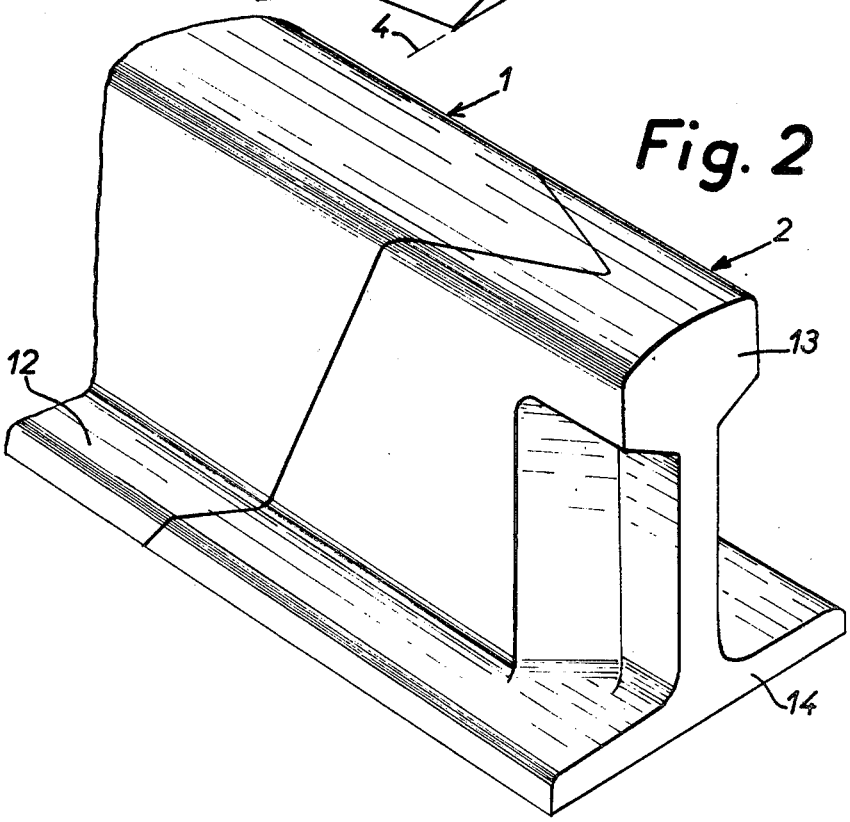
FIG. 2 is a perspective view showing the end of a track component on which an end piece has been cast.
Figure 4:
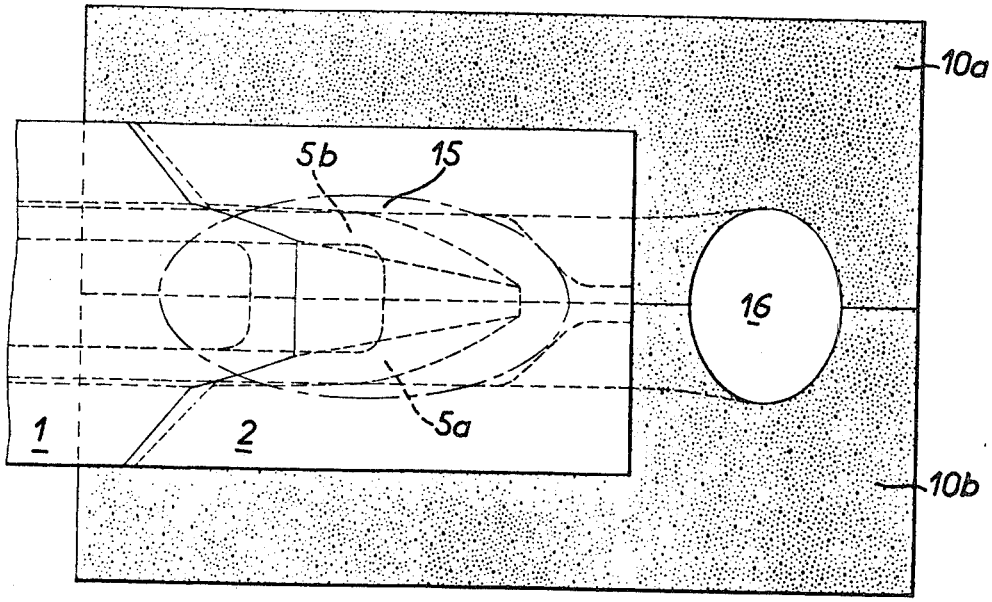
FIG. 4 is a horizontal section taken along the line IV—IV of FIG. 5.

In FIGS. 1 and 2 of the drawings the reference numerals 1 and 2 designate the end of a track component and the corresponding end piece 2, respectively. The end 1 on which an end piece 2 is to be cast comprises a front surface 3 inclined about a transverse horizontal axis 4. This end 1 further comprises a pair of opposite lateral surfaces 5*a*, 5*b* inclined towards the median plane of symmetry 6 of said end 1 and also upwardly so that said front surface has a triangular or trapezoidal shape having its minor base 7 coincident or level with the running surface or tread 8 of the end 1 of said component.

Figure 3:
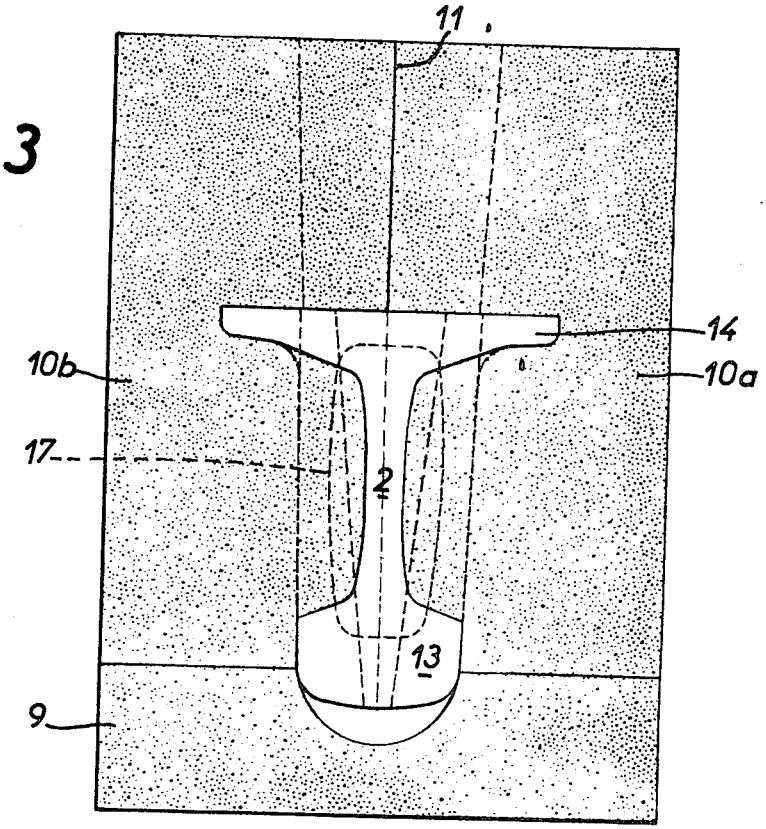
FIG. 3 is a cross section taken along the line III—III of FIG. 5, showing the mould utilizable for casting the end piece according to this invention.
Figure 5:
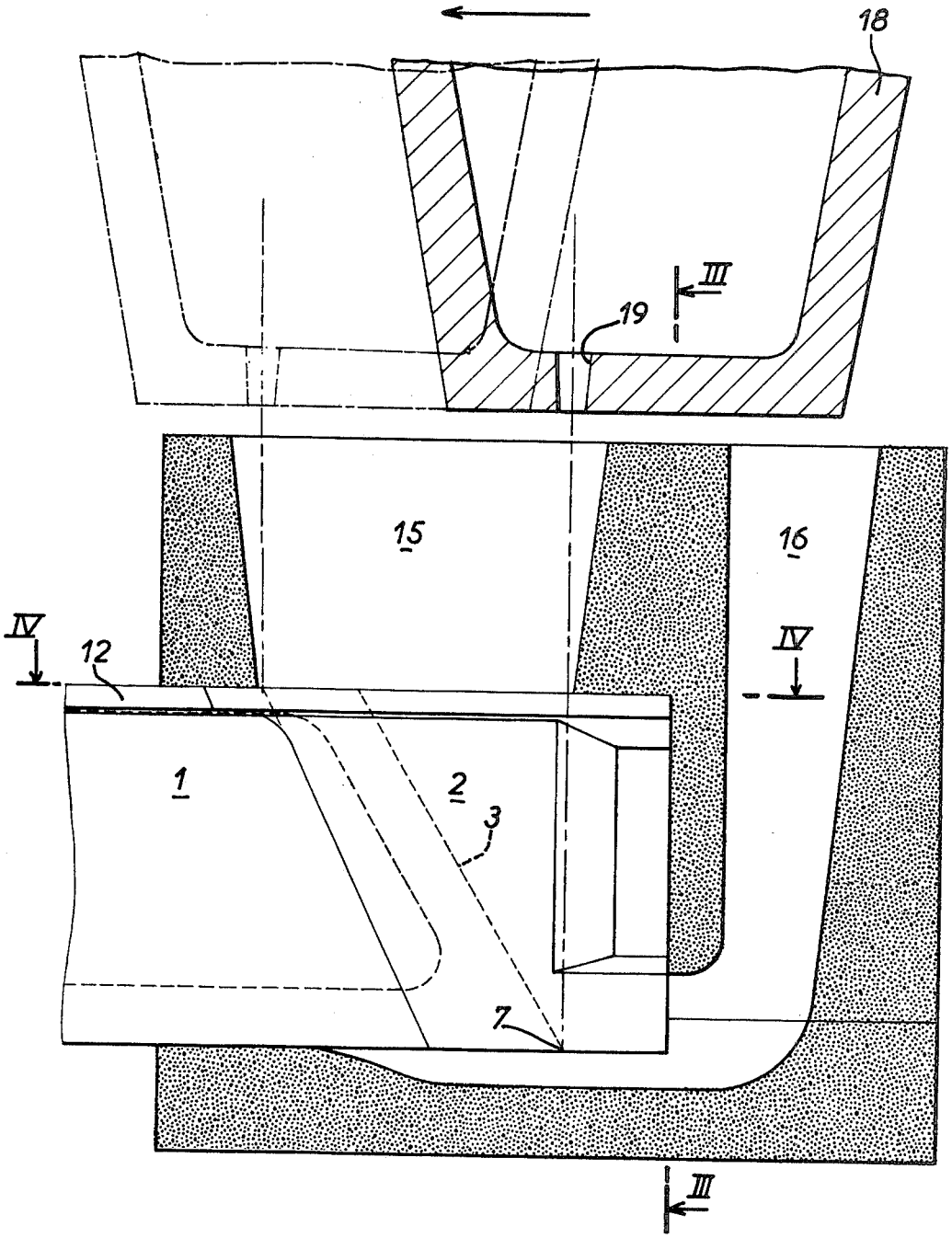
FIG. 5 is a longitudinal section showing the mould and crucible assembly, the end of a track component provided with its end piece being shown in elevation.

FIG. 3 illustrates the mould in which the end piece 2 is cast on the end 1 of said component. This mould comprises three main sections, namely a lower horizontal section 9 and two vertical symmetrical sections 10*a* and 10*b*. The joint 11 between the two vertical lateral sections 10*a*, 10*b* lies in the median plane 6. The end 1 of this component projects into the mould to an extent sufficient to prevent any leakage from developing when casting the end piece notably at the foot 12 thereof (FIGS. 1 and 2).

According to a preferred form of embodiment, the mould is filled in such a manner as to cast the head 13 of end piece 2 before the foot 14. This filling or downhill casting operation is accomplished through a top hole 15. A heel hole 16 is provided in order properly to fill up the mould cavity for the end piece. The risers corresponding to the top hole 15 and heel hole 16 are removed after stripping the track component provided with its end piece.

The mould 9, 10*a*, 10*b* is so designed that the end piece 2, in the junction areas corresponding to planes 3, 5*a*, 5*b*, has a profile similar to that of a solid section of the end 1 of the track component, and a rail section, for example a Vignole rail section, at its opposite end. Furthermore, the end 1 of this component may advantageously have a tubular cross section as shown at 17 in FIG. 3.

According to this invention, a homogeneous casting of the end piece is obtained by causing the crucible 18 filled with molten metal, to travel over this mould in a substantially longitudinal direction so that the casting hole 19 of said crucible 18 moves gradually from a point overlying the minor base 7 of the track component to a point overlying the foot 12 of the end 1 of this track component.

According to a modified form of embodiment of the method of this invention the end pieces are cast at the ends of the rough-cast track component proper, without allowing the latter to cool down. For this purpose, the solid portion of the mould for casting the track component comprises adjacent each end thereof a partition permitting, after casting said component, of freeing its ends and fitting another mould 9, 10*a*, 10*b* for casting the end pieces 2.

The molten metal necessary for casting the end pieces 2 may be produced in a metallurgical furnace or through any other known and suitable melting method.

Of course, this invention should not be construed as being strictly limited by the specific form of embodiment described hereinabove and illustrated in the accompanying drawings, since it is also applicable to the manufacture of any manganese steel parts provided with end pieces for joining or binding said parts by welding to another part consisting of any desired other alloy.

What is claimed as new is:

1. Method of providing at least one end of an austenitic manganese steel track component containing 12 to 14 percent by weight of manganese with a corresponding steel end piece of mainly an austenitic structure and having a foot and a head, said manganese steel track component having an upper surface forming a rolling tread and presenting at said one end a front end surface, comprising the steps of:

providing said front end surface with an inclination about a transverse horizontal axis, forming at said front end surface two opposite lateral end surfaces inclined towards a vertical median plane of said one end, whereby giving to the front end surface a trapezoidal configuration with a minor base coincident with said upper rolling tread, and casting said corresponding steel end piece in a mould disposed directly at said one end of said manganese steel track component.

2. Method according to claim 1, wherein said steel end piece is cast upside down in claim line 3, with the casting material being initially poured directly into the mould area defining the head of said end piece.

3. Method according to claim 1, wherein the step of casting said corresponding end piece is accomplished by moving a crucible loaded with molten metal over said mould in a longitudinal direction with respect to said manganese steel track component.

4. Method according to claim 1, wherein the step of providing said front end surface with an inclination is accomplished by casting said manganese steel track component in a mould and wherein the step of casting the corresponding steel end piece is accomplished before the manganese steel track component is cooled.

5. An austenitic steel track comprising an austenitic manganese steel component containing 12 to 14 percent be weight of manganese provided at least one end with a corresponding steel end piece having mainly an austenitic structure, said austenitic manganese steel component having an upper surface forming a rolling tread and presenting at said one end a front end surface in contact with said steel end piece, said front end surface being inclined about a transverse horizontal axis and having a tropezoidal configuration with a minor base coincident with said upper rolling tread, and two opposite lateral end surfaces inclined towards a median plane of said one end, one on each side of said front end surface.

* * * * *